United States Patent [19]

Allen

[11] Patent Number: 4,810,312

[45] Date of Patent: Mar. 7, 1989

[54] TREATMENT OF SUPERALLOY SURFACES

[75] Inventor: David J. Allen, Derby, England

[73] Assignee: Rolls-Royce plc, London, England

[21] Appl. No.: 122,228

[22] Filed: Nov. 18, 1987

[30] Foreign Application Priority Data

Jan. 16, 1987 [GB] United Kingdom ..... 8700950

[51] Int. Cl.[4] ..... C21D 1/68

[52] U.S. Cl. ..... 148/13.1; 148/20.3

[58] Field of Search ..... 148/20, 20.6, 20.3, 148/13.1, 3; 204/129.35; 427/154, 156

[56] References Cited

U.S. PATENT DOCUMENTS

| | | | |
|---|---|---|---|
| 2,132,557 | 10/1938 | Bobrov | 148/20.6 |
| 2,142,869 | 1/1939 | Fraser | 427/156 |
| 2,742,382 | 4/1956 | Chambers | 148/20.6 |
| 4,234,397 | 11/1980 | Torrey | 204/129.35 |

*Primary Examiner*—Christopher W. Brody

*Attorney, Agent, or Firm*—Cushman, Darby & Cushman

[57] ABSTRACT

A superalloy which is to be solution heat treated is first coated with a vapor barrier, so as to reduce the loss of surface material during the heat treatment step. The advantage gained is the maintenance of an etchable surface for grain boundary inspection purposes.

5 Claims, No Drawings

TREATMENT OF SUPERALLOY SURFACES

This invention relates to the treatment of the surface of a cast superalloy object so as to prevent loss of material during a heating process.

Whilst the invention is applicable to objects which have a deliberately multi crystal structure, it has particular applicability to objects which are manufactured by "growing" a single crystal during the casting process, which single crystal on completion of casting should define the entity. The state of the art in single crystal casting however is such that the designed condition i.e. a truly single crystal object which has no grain boundaries within its periphery cannot yet be achieved.

Since the mechanical strength of the object will be dictated by its structure and the theoretical strength of the object will be calculated on the basis of it being a truly single crystal structure, it is of vital importance that the object be inspectable so as to enable ascertainment of its actual structure and therefore its actual strength.

It is known to prepare the surface of superalloy objects for inspection, by first electrolytically etching the object so as to expose the grain boundaries which can then be viewed by any one of a number of well known devices. However, it is frequently necessary to condition the object first, by way of submitting it to a "solution heat treatment" step. Such treatment results in the object embodying its desired properties. "Solution heat treatment" is a well known, widely practiced technique and will not be enlarged upon herein.

It has been found that after the solution heat treatment step and electro etching have been performed, some superalloys e.g. nickel/Chrome superalloys, exhibit a highly polished surface. This is the result of loss of surface material through vaporisation during the heat treatment, which in turn affects the etching characteristics of the superalloy object.

Several methods have been tried in an attempt to re-condition the surface so as to make it etchable. These include the following:

(a) Modified electro etch parameters
(b) Variation of cooling rate subsequent to solution heat treatment.
(c) Sandblasting after solution heat treatment.
(d) Emery dress after solution heat treatment.

It was found that neither "a" or "b" solved the problem and that "c" and "d" generated dimensional inaccuracies. Moreover, they represent extra operations hich adds cost to the production of the object.

The present invention seeks to provide an improved method of treating the surface of a superalloy object so as to enable etching and so assist inspection.

According to the present invention a method of treating the surface of a superalloy object prior to effecting a heat treatment step so as to at least substantially reduce loss of surface material from the object through vapourisation, comprises the step of coating the obect with a charable, inert barrier substance and then heating the object to the heat treatment temperature in a low pressure, inert atmosphere and thereafter cooling the object and removing the charred barrier substance.

The substance may be any substance which is inert with respect to the material of the object that is, substance is stable in the heat treatment temperature range.

The method may include coating the object with a metal oxide.

The method may include applying the substance by brushing.

The invention will now be described by way of the following example:

Turbine blades for gas turbine engines of the kind which power aircraft, are made from superalloys e.g. nickel chrome alloys. This is well known in the art. Further, it is known to manufacture superalloy turbine blades by the growth of a single crystal into a virtually finished product, at least so far as the aerofoil portion of the blade is concerned. The process described so far is well known and will not be enlarged upon herein.

On completion of the casting process the blade is cleaned and then coated with a substance such as Titanium Oxide, or Aluminum Oxide. The substance may be applied by any suitable means which will give a reasonably consistent thickness, which should not be more than 0.5 thousandths of one inch (approximately 0.1 mm). Thereafter the coated blade is placed in a furnace which is then evacuated. An inert gas e.g. argon is pumped in to raise the pressure to some low value i.e. less than atmospheric pressure. The blade is then "solution heat treated" by heating it to a temperature which is just below the solidus of the alloy and then effecting cooling to ambient atmosphere, still within the furnace. The temperature and time ranges for these steps are known and so will not be stated. It is by this means that the necessary properties are achieved.

On removal of the blade from the furnace, the now charred coating is removed by any suitable means e.g. rubbing or light sand blasting. The blade is then electrolytically etched so as to enable inspection of the grain boundaries.

The application of the coating prior to heat treatment reduces the loss of material from the surface of the blade, that would otherwise occur through vaporisation. In the past, without the coating step, such loss changed the characteristics of the material surface in a way which resulted in a highly polished surface being produced on the blade, when the electrolytic etching step was carried out. This defeated the object of exposing the grain bounderies.

A main criteria for any substance which is used to coat the blade, is that it should be stable at the high temperatures which are involved i.e. the substance should not react with the material of the blade such as to contaminate it by changing its alloy characteristics. Further, it should remain substantially intact as a coating.

I claim:

1. A method of treating the surface of a superalloy object prior to effecting a heat treatment step so as to at least substantially reduce loss of surface material from the object through vapourisation, comprising the step of coating the object with a charable barrier substance which is also inert with respect to the superalloy and then heating the object to the heat treatment temperature in a low pressure, inert atmosphere and thereafter cooling the object and removing the charred barrier substance.

2. A method of treating the surface of a superalloy object as claimed in claim 1 wherein the coating substance is a metallic oxide.

3. A method of treating the surface of a superalloy object as claimed in claim 2 wherein the metallic oxide is Titanium Oxide.

4. A method of treating the surface of a superalloy object as claimed in claim 2 wherein the metallic oxide is Aluminium Oxide.

5. A method of treating the surface of a superalloy object as claimed in any preceding claim wherein the superalloy is Nickel/Chrome.

* * * * *